US005088373A

United States Patent [19]

Hou

[11] Patent Number: 5,088,373

[45] Date of Patent: Feb. 18, 1992

[54] MOVING ORNAMENTAL DISPLAY ASSEMBLY

[76] Inventor: Jack Hou, P.O. Box 78-5, Taipei, Taiwan

[21] Appl. No.: 581,305

[22] Filed: Sep. 12, 1990

[51] Int. Cl.[5] ..... G10F 1/06

[52] U.S. Cl. ..... 84/95.2; 446/298

[58] Field of Search ..... 84/94.1, 94.2, 95.1, 84/95.2; 446/297, 298, 301, 342

[56] References Cited

U.S. PATENT DOCUMENTS 4,708,689 11/1987 Hou ..... 84/95.2

*Primary Examiner*—Brian W. Brown

*Attorney, Agent, or Firm*—Bacon & Thomas

[57] ABSTRACT

An ornamental display assembly is disclosed in which an ornamental object is moved along a reciprocating path of movement by a wind-up music box mechanism. A crank mechanism operated by the music box causes a follower to reciprocate along a generally vertical path of motion. The ornamental object is not attached directly to the follower, but is attached to an arm member which, in turn, is attached to the follower. The relative positioning between the arm (and the ornamental object) with respect to both the follower and the music box mechanism may be varied by changing the position of the arm. A guide member is associated with the distal end of the arm to prevent any irregular motion of the ornamental device during the movement.

8 Claims, 2 Drawing Sheets

MOVING ORNAMENTAL DISPLAY ASSEMBLY

BACKGROUND OF THE INVENTION

The present invention relates to ornmental display assemblies, more particularly such assemblies wherein an ornamental object undergoes reciprocating motion.

Ornamental display assemblies having movable elements are general well-known in the art. Such assemblies may assume the configuration of a carousel which rotates about a generally vertical axis while the horses of the carousel undergo vertical reciprocating motions. It is also known to include a music generating mechanism, such as a music box, to provide musical background while the assembly performs its motions.

It is also known to provide a stationary base on which one or more ornamental objects are mounted and to provide an appropriate power drive source to cause the objects to move with respect to the stationary base.

In the known ornamental display assemblies, the ornamental object is typically attached directly to a follower that moves in a reciprocating path. This limits the relative positioning between the ornamental object and the power source which inherently limits the aesthetic aspects of the device.

SUMMARY OF THE INVENTION

An ornamental display assembly is disclosed in which an ornamental object is moved along a reciprocating path of movement by a wind-up music box mechanism. A crank mechanism operated by the music box causes a follower to reciprocate along a generally vertical path of motion. The ornamental object is not attached directly to the follower, but is attached to an arm member which, in turn, is attached to the follower. The relative positioning between the arm (and the ornamental object) with respect to both the follower and the music box mechanism may be varied by changing the position of the arm. A guide member is associated with the distal end of the arm to prevent any irregular motion of the ornamental device during its movement.

While such devices have provided untold hours of amusement for users, their drive mechanisms are often complex. Such complex drive mechanisms are costly to manufacture and are inherently subject to numerous mechanical break downs.

DETAILED DESCRIPTION OF THE PREFERRED EMBODIMENT

Figure 1:
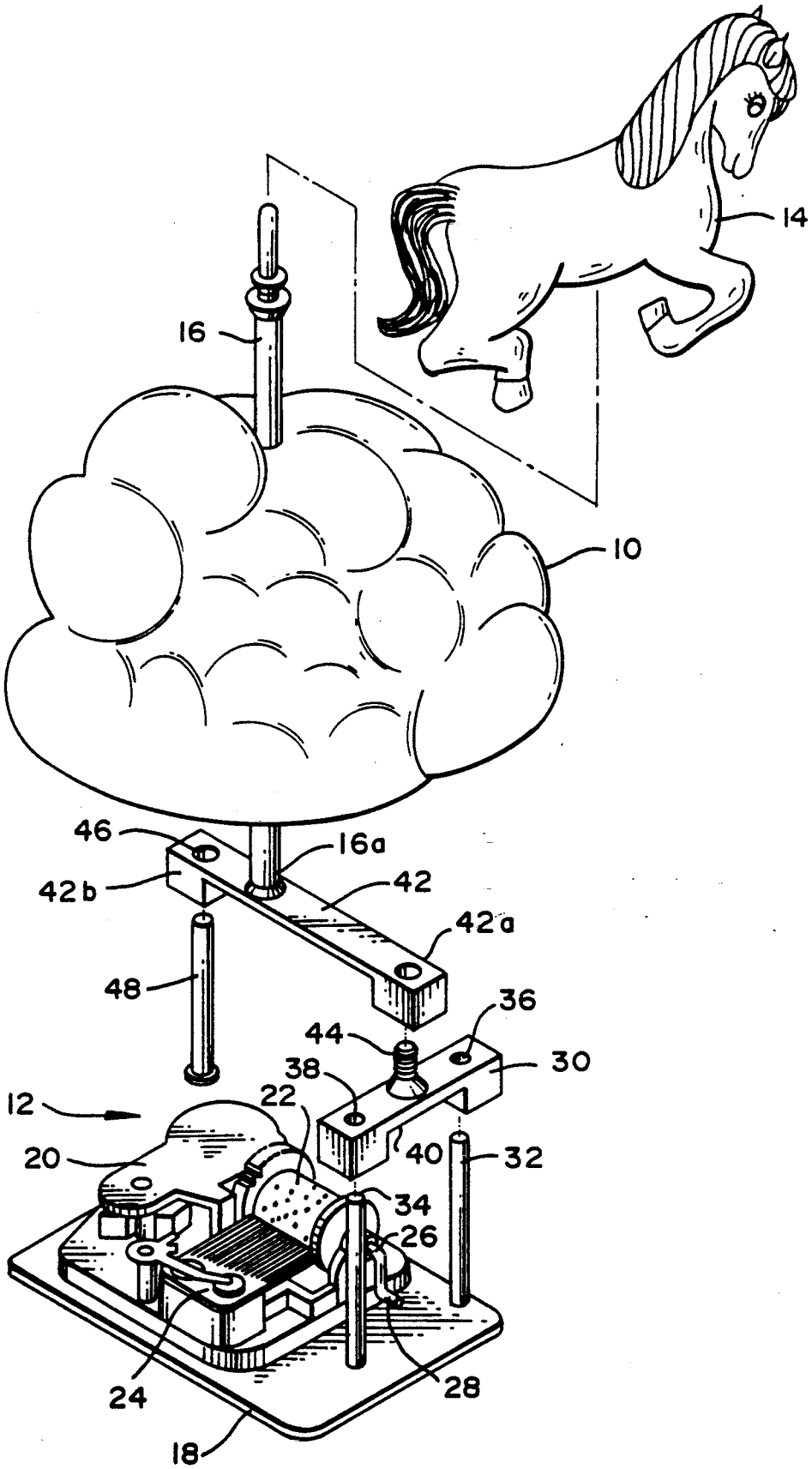
FIG. 1 is an exploded, perspective view of the ornamental display assembly according to the present invention.

The ornamental display assembly according to the present invention comprises a housing 10 which completely enclosed actuating mechanism, indicated generally at 12. The exterior surface of the housing 10 may have a decorative, aesthetically pleasing design, as illustrated. An ornamental object 14, such as a horse, or the like, is fixedly attached by known means, to tappet rod 16 which slidingly extends through the housing 10.

The actuating mechanism 12 comprises a base member 18 on which is mounted a music box mechanism 20 of known construction. As is well-known in the art, the music box mechanism 20 may be a wind-up type having a rotating drum 22 such that protrusions on the drum 22 contact musical element 24 as the drum rotates in order to produce the desired musical sounds.

Rotating drum 22 has rotating power output shaft 26 which rotates with the drum and to which is attached a crank mechanism having an eccentric cam element 28. Due to its eccentric location with respect to the output shaft 26, cam element 28 rotates in a circle about the rotational axis of output shaft 26 as the drum 22 rotates.

A follower member 30 is slidably mounted on guide rods 32 and 34 which are, in turn, fixedly attached to base member 18. Follower member 30 defines openings or holes 36 and 38 which slidably accommodate the guide rods 32 and 34, respectively.

Follower member 30 also defines surface 40 which slidably bears against the cam element 28. Thus, it can easily be seen that, as output shaft 26 rotates, the circular motion of cam element 28 bearing against surface 40 will cause the follower member 30 to undergo reciprocating movement in a generally vertical direction in a plane extending generally perpendicular to the axis of the output shaft 26.

Figure 2:
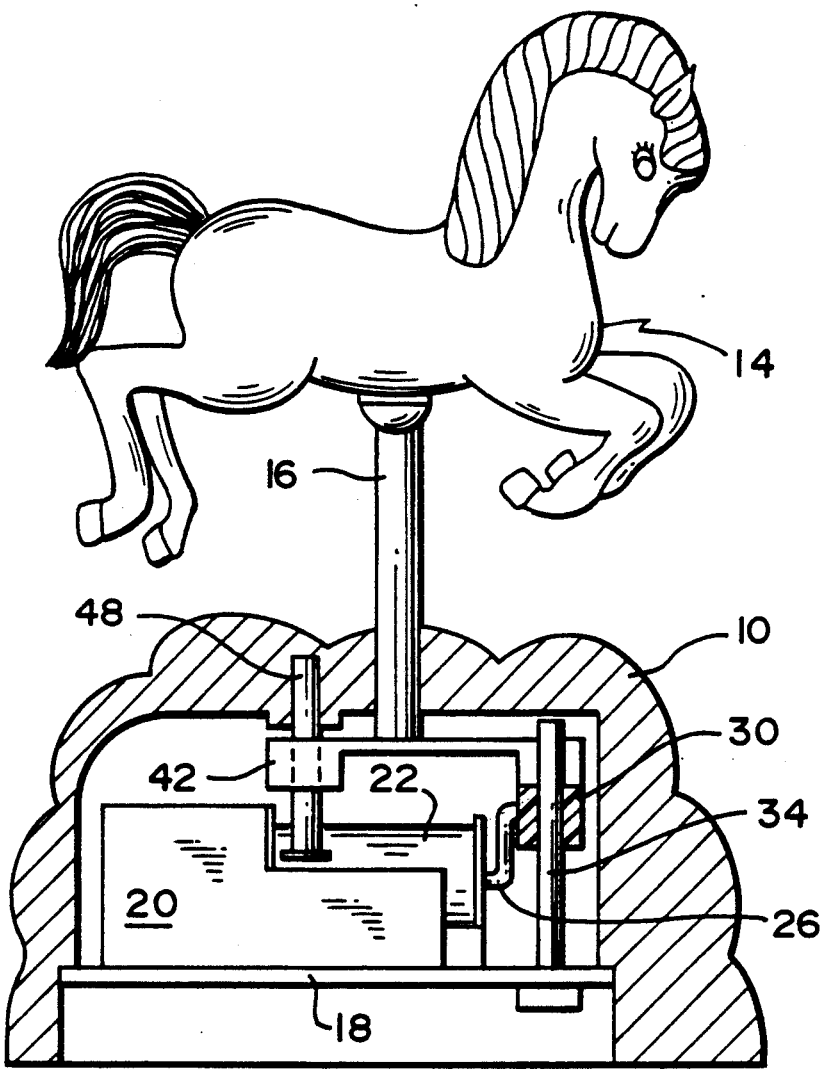
FIG. 2 is a side view, partially in section, of the ornamental display assembly illustrated in FIG. 1.

Arm member 42 has a first end portion **42*a* fixedly attached to the follower member 30 by any known means, such as a threaded stud 44. A second end portion 42*b* defines an opening 46 which slidably accommodates guide rod 48. As illustrated in FIG. 2, guide rod 48 may be fixedly attached to an inner portion of housing 10. As an alternative embodiment, guide rod 48 can be attached to an upper portion of the music box mechanism 20. An inner end 16*a* of tappet rod 16 is fixedly attached to the arm member 42**.

It can be seen that rotation of drum 22 will cause reciprocating movement of follower member 30 along the guide rods 32 and 34. Such reciprocating movement is imparted to the arm member 42 via its attachment with the follower member 30. The distal end of the arm member 42 is slidably guided along guide rod 48. Such reciprocating movement of the arm member 42 is also imparted to the ornamental object 14 via tappet rod 16. Thus, the music box mechanism 20 provides the sole source of power for actuating the ornamental object in addition to providing the musical accompaniment.

The use of arm member 42 enables the relative positions between the music box mechanism 20 and the ornamental object 14 to be individually tailored for any particular exterior housing. The location of the ornamental object need not be limited to being directly above the follower member 30 as in the prior art devices. Quite obviously, the length of arm member 42, as well as its position relative to follower member 30 may be suitably varied. Arm member 42 may extend generally parallel to follower member 30 or may be oriented at any angle with respect thereto.

Furthermore, tappet member 16 may be positioned at any location along the length of arm member 42, depending upon its desired position relative to the exterior housing 10. The use of the guide post 48 to guide the distal end of arm member 42 prevents any wobbling or unsteady motion by the ornamental object as it reciprocates.

The foregoing description is provided for illustrative purposes only and should not be construed as in any way limiting this invention, the scope of which is defined solely by the appended claims.

We claim:

1. An ornamental display assembly comprising:

a) a base member;

b) a music box mechanism having a rotating power output shaft;

c) a crank mechanism operatively associated with the rotating output shaft, the crank mechanism having a cam element located eccentrically with respect to the rotating output shaft;

d) a follower member operatively associated with the cam element such that rotation of the output shaft causes reciprocating motion of the follower member;

e) an arm member having a first end attached to the follower member such that the arm member reciprocates with the follower member, and a second end;

f) first guide means operatively associated with the arm member;

g) at least one ornamental object; and, h) means to attach the at least one ornamental object to the arm member.

2. The ornamental display assembly of claim 1 further comprising second guide means operatively associated with the follower member.

3. The ornamental display assembly of claim 2 wherein the second guide means comprises:

a) at least one guide rod; and, b) at least one opening defined by the follower member so as to slidably accept the at least one guide rod.

4. The ornamental display assembly of claim 2 further wherein the first guide means is operatively associated with the second end of the arm member.

5. The ornamental display assembly of claim 4 wherein the first guide means comprises:

a) at least one guide rod; and, b) at least one opening defined by the arm member so as to slidably accommodate the at least one guide rod.

6. The ornamental display assembly of claim 5 further comprising a housing attached to the base member.

7. The ornamental display assembly of claim 6 wherein the at least one guide rod is attached to the housing.

8. The ornamental display assembly of claim 1 wherein the means attaching the ornamental object to the arm member comprises a tappet rod having a first end attached to the arm member and a second end attached to the ornamental object.

* * * * *